US011771154B2

(12) United States Patent
Berrebi

(10) Patent No.: US 11,771,154 B2
(45) Date of Patent: Oct. 3, 2023

(54) CONVERTIBLE GARMENT

(71) Applicant: Nathalie Berrebi, Paris (FR)

(72) Inventor: Nathalie Berrebi, Paris (FR)

( * ) Notice: Subject to any disclaimer, the term of this patent is extended or adjusted under 35 U.S.C. 154(b) by 521 days.

(21) Appl. No.: 16/062,226

(22) PCT Filed: Dec. 19, 2016

(86) PCT No.: PCT/FR2016/053548

§ 371 (c)(1),
(2) Date: Jun. 14, 2018

(87) PCT Pub. No.: WO2017/103549

PCT Pub. Date: Jun. 22, 2017

(65) Prior Publication Data

US 2018/0368496 A1 Dec. 27, 2018

(30) Foreign Application Priority Data

Dec. 17, 2015 (FR) ..... 15 62624

(51) Int. Cl.
*A41D 15/00* (2006.01)
*A41D 1/14* (2006.01)
(Continued)

(52) U.S. Cl.
CPC ..... *A41D 15/00* (2013.01); *A41D 1/14* (2013.01); *A41D 3/08* (2013.01); *A41D 7/008* (2013.01)

(58) Field of Classification Search
CPC ..... A41D 15/00; A41D 13/1245; A41D 1/21; A41D 1/215; A41D 1/22; A41D 3/08; A41D 7/008
(Continued)

(56) References Cited

U.S. PATENT DOCUMENTS 1,107,303 A * 8/1914 Henderson ..... A41D 15/00 2/70
1,272,942 A * 7/1918 Goldstein ..... A41D 3/08 2/88
(Continued)

FOREIGN PATENT DOCUMENTS

DE 20 2015 001265 U1 7/2015
FR 3 018 165 A3 9/2015
WO WO 2010/143211 A1 12/2010

OTHER PUBLICATIONS

Burda Style Magazine, Caftan with Tie Binds, https:www.burdastyle.com/projects/32011-caftan-with-tie-bands/instructions/2, Apr. 7, 2011 (Year: 2011).*
(Continued)

*Primary Examiner* — Heather Mangine
(74) *Attorney, Agent, or Firm* — von Briesen & Roper, s.c.

(57) ABSTRACT

A convertible garment intended to be worn in a plurality of wearing configurations by an individual/user, the garment comprising a front panel and a rear panel connected to each other by a left-hand junction and a right-hand junction located to either side of a central opening, extended on the front side by a indentation (teardrop neckline), a strap/lash comprising a central portion attached to the edge of the central opening but not to the edge of the teardrop neckline, and free portions extending the central portion, two symmetrical passages, each comprising a first slit in the front panel, a second slit in the rear panel and a sewn link, linking the front and rear panels close to the slits, the garment being free of stitching linking the side edges of the front and rear panels, the developed length of the edge of the central opening LD excluding the teardrop neckline and the developed length of the edge of the teardrop neckline LF being such that said garment can be worn at least either in tunic
(Continued)

configuration, in poncho configuration, in backless dress configuration or in skirt configuration.

10 Claims, 7 Drawing Sheets

(51) Int. Cl.
*A41D 3/08* (2006.01)
*A41D 7/00* (2006.01)

(58) Field of Classification Search
USPC ..... 2/74, 88, 105, 114
See application file for complete search history.

(56) References Cited

U.S. PATENT DOCUMENTS 1,398,165 A * 11/1921 Whiteside ..... A41D 3/08 2/171
1,497,685 A * 6/1924 Hoyme ..... A41D 7/008 2/67
1,556,747 A * 10/1925 Bates, Jr. ..... A41B 13/06 128/872
1,569,960 A * 1/1926 Geisler ..... A41D 3/08 2/88
1,758,323 A * 8/1928 Korff ..... A41D 15/00 2/89
2,136,889 A * 11/1938 Richards ..... A41D 3/08 2/84
2,237,368 A * 2/1940 Seitzman ..... A41D 15/00 2/91
2,302,844 A * 11/1942 Ebbott ..... A41D 15/04 2/88
2,408,662 A * 10/1946 Levitt ..... A41D 3/08 2/84
2,555,962 A * 6/1951 Einstein ..... A41D 1/00 2/74
2,698,944 A * 7/1951 Ramsby ..... A42B 1/041 2/174
2,717,390 A * 9/1955 Houze ..... A41D 15/00 2/74
2,808,591 A * 10/1957 Grant ..... C02F 1/14 2/88
RE24,461 E * 4/1958 Macrides ..... A41B 1/10 2/128
3,013,274 A * 12/1961 Dike ..... A41D 7/008 2/69
3,381,306 A * 5/1968 Innes ..... A47G 9/086 2/69
3,522,612 A * 8/1970 Palmer ..... A41D 15/00 2/88
3,707,729 A * 1/1973 Scarsella ..... A41D 3/08 2/88
3,935,596 A * 2/1976 Allen, Jr. ..... A41D 13/1209 2/114
4,227,264 A * 10/1980 Spector ..... A41D 15/00 2/84
4,543,668 A * 10/1985 Franklin ..... A41B 13/10 2/48
4,558,468 A * 12/1985 Landry ..... A41D 13/1209 2/114
4,683,594 A * 8/1987 Feinberg ..... A41D 13/1236 2/105
4,764,985 A * 8/1988 Wade ..... A41D 3/08 2/114
4,860,383 A * 8/1989 Warn ..... A41D 15/00 2/88
4,975,984 A * 12/1990 Sting ..... A41D 13/04 2/105
5,150,477 A * 9/1992 Elberson ..... A41D 13/1236 2/114
5,697,102 A * 12/1997 Benjamin ..... A41D 7/008 2/69
6,185,743 B1 * 2/2001 Mick ..... A41D 3/08 2/69
6,237,153 B1 * 5/2001 Bowens ..... A41D 13/1236 2/114
6,708,343 B1 * 3/2004 Ceron ..... A41D 3/08 2/84
7,424,750 B2 * 9/2008 Kerr ..... A41D 13/1236 2/114
7,823,220 B2 * 11/2010 Mazzarolo ..... A41D 15/00 2/108
7,823,229 B2 11/2010 Mazzarolo
8,214,923 B2 * 7/2012 Lee ..... A41D 15/00 2/69.5
2004/0216212 A1 * 11/2004 Newman ..... A41D 13/129 2/69
2004/0237167 A1 * 12/2004 Curry ..... A41D 3/08 2/88
2005/0102727 A1 * 5/2005 Kelly ..... A41D 7/008 2/69
2006/0010555 A1 * 1/2006 Hayes ..... A41D 13/0015 2/69
2008/0178364 A1 * 7/2008 Brickie ..... A41D 15/00 2/69.5
2015/0089712 A1 * 4/2015 Gamble ..... A41D 3/08 2/88
2016/0029718 A1 * 2/2016 Darnell ..... A47G 9/062 34/91
2016/0095366 A1 * 4/2016 Pruitt ..... A41D 13/1281 2/114
2018/0070661 A1 * 3/2018 McAndrew ..... A41D 3/08
2018/0146723 A1 * 5/2018 Munro ..... A41D 3/08

OTHER PUBLICATIONS

Burda Style Magazine, Caftan with Tie Binds, https:www.burdastyle.com/projects/32011-caftan-with-tie-bands/instructions/2, Apr. 7, 2011 (with date project added shown) (Year: 2011).*
International Search Report related to Application No. PCT/FR2016/053548; dated Mar. 17, 2017.

* cited by examiner (Light poncho wear)

(Backless dress)

(Skirt)

(Sarouel)

CONVERTIBLE GARMENT

CROSS-REFERENCE TO RELATED APPLICATION

This Application is a 35 USC § 371 US National Stage filing of International Application No. PCT/FR2016/053548 filed on Dec. 19, 2016, and claims priority under the Paris Convention to French Patent Application No. 15 62624 filed on Dec. 17, 2015.

FIELD OF THE DISCLOSURE

The present invention is about apparel, specifically convertible or modular garment, which may be worn by an individual in several configurations of wearing.

Some have already tried submitting convertible clothing.

Most rely on removable or collapsible components such as the items featured in the U.S. Pat. Nos. 4,227,264 or 7,823,220.

BACKGROUND OF THE DISCLOSURE

Others have put forward a piece of clothing in the form of multi-usage fabric as U.S. Pat. No. 8,214,923 for a known example; however, the setting up of such a piece on the user in the desired configuration turned out to be difficult.

The demand for continued improvement on convertible apparel remains.

SUMMARY OF THE INVENTION DISCLOSURE

To this end, it is proposed here a convertible garment, intended to be worn in several configurations of wearing by an individual/user relative to which are defined a symmetric longitudinal plane (P1) and the terms front, back, left and right, the garment comprising:

and front panel (1) and a back panel (2) bound together at an intermediary area (P2) by a left junction (80) and a right junction (8D) located on both sides of a central aperture, with an indentation (4) extending from a front side of the central aperture, a lash (5) comprising a central section (50) fixed on the edge of the central aperture but not on the edge of the indentation, and free sections (51, 52) extending from both sides of the central section, the garment being deprived of a stitching connection joining the lateral borders (12, 14, 22, 24) of the front and back panels, at least two seam connections, a right-hand (71,71') and a left-hand (72,72') seam connection, joining the front and back panels, the aforementioned seam connections being arranged symmetrical on both sides of the longitudinal plane of symmetry (P1), away from the lateral borders (12, 14, 22, 24), wherein the developed length of the edge of the central aperture, excluding the indentation, denoted LD, is comprised between 60 and 100 cm, preferably between 70 cm and 95 cm, and more preferably between 78 cm and 86 cm, and the developed length of the indentation denoted LF is comprised between 10 cm and 25 cm, preferably between 14 cm and 25 cm, and more preferably between 15 cm and 20 cm.

Whereby the garment can be worn either in a tunic configuration, a poncho configuration, a backless dress configuration, a skirt configuration, an asymmetric configuration, or in a sarouel configuration.

Those different configurations are achieved by positioning the central aperture either at neck/shoulder level, high torso level, or waist (i.e. hips) level, then by pulling tight or loose the free sections of the lash and knotting them in place. The seam connections allow for cohesion and a nice fit.

The opening/enlarging or closing/tightening of the indentation allows to match cleverly the peripheral length of the aperture with the local circumference of the wearer's body.

Note that the garment is intended for women, but it is not excluded that it may be one day worn by men.

In several mode of embodiment of the invention, the following configurations may be used:

The garment may include at least two passages (6G, 6D), respectively right and left, each passage comprising a first slit (61) in the front panel, a second slit (62) in the back panel, each passage being arranged near the corresponding respective seam connection. These passages allow for the passing of a belt.

The garment may include a belt (9) meant to be threaded through the passages. The belt may be used in the tunic configuration, or poncho configuration or belt configuration (wide or fitted mode).

The length (K) separating the two seam connections (71, 72) may be comprised between 50 cm and 85 cm, preferably between 70 cm and 85 cm, and more preferably between 72 cm and 75 cm; this give a geometric configuration optimised for the garment to perfectly fit whatever the configuration.

There may be provided a right-side attachment piece (71, 71') forming the right-hand seam connection and a left-side attachment piece (72, 72') forming the left-hand seam connection, each attachment piece being sewn to the back panel and to the front panel. Around this area, this allows for some freedom of movement of the front and back panels.

Furthermore, each attachment piece is formed by a double buttonholes eyelet piece, folded back onto itself, thus doubling the back panel and the front panel, the two buttonholes and the two slits being aligned to form together passages to allow for the threading of a belt; this forms a strong seam connection which avoids tears or local rupture of a simple seam.

Each free section (51, 52) of the lash measures over 30 cm, preferably over 40 cm, and more preferably over 50 cm, this allows to tie the knot on the opposite side of the indentation by wrapping around the wearer's body even for large/extra large sizes.

Advantageously, the garment may be deprived of any detachable component and any linking components such as snap fasteners, zippers, scratches, etc . . . .

Advantageously the garment may be made out of no-extensible or little extensible material. The front panel (1) and the back panel (2) may have substantially the same size, with the height A being comprised between 55 cm and 100 cm, preferably between 70 cm and 100 cm, and more preferably between 70 cm and 85 cm, and the width B being comprised between 70 cm and 115 cm, preferably between 95 cm and 115 cm and more preferably between 100 cm and 110 cm.

The left and right junctions (8G, 8D) are formed by the seams; and slant/inclined junction may be formed (slope C); this offset in height, preferably between 5 and 8 cm, allows for an adequate shoulder fit.

The seam connections are located away from a top and of the garment, at a distance (E) preferably comprised between 35 cm and 45 cm; this is an appropriate compromise so that the garment may be put on and ensure a sufficient cohesion between the front and the back panels.

In a variation, the front and back panels may come integrally from a single piece of cloth. In this case, the shoulder slope denoted C is null. Continuous patterns without seam/join connection on the shoulder area may be proposed. A placed pattern fabric may be used more easily.

BRIEF DESCRIPTION OF THE DRAWINGS

Other characteristics and advantages provided by the invention will be revealed along the following description of its embodiments, featured as nonlimited examples with regards to the figures enclosed for which.

DETAILED DESCRIPTION OF THE DISCLOSURE

On the different figures, the same references point to the similar or identical elements.

Figure 1:
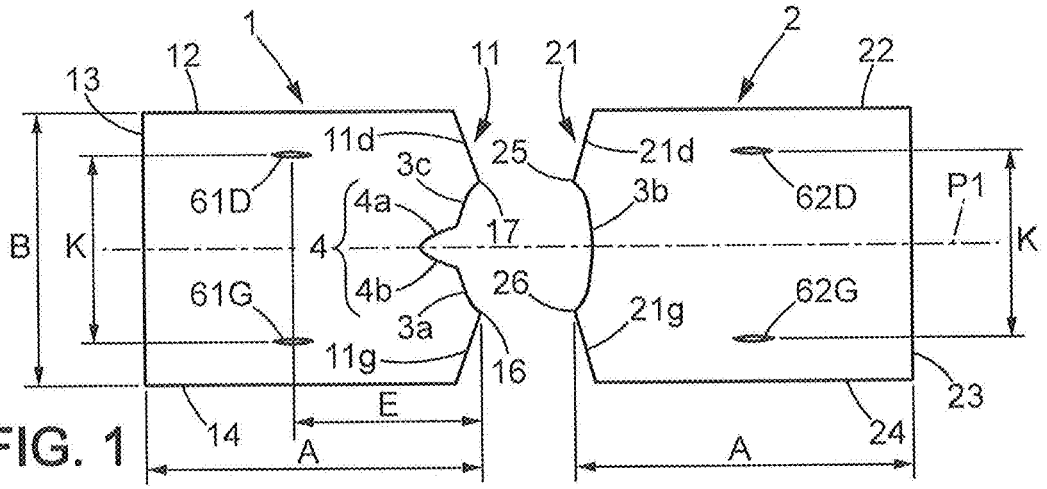
FIG. 1 represents for a first mode of embodiment a view of the flattened front and back panels, intended to be assembled in a convertible garment according with the present invention.
Figure 2:
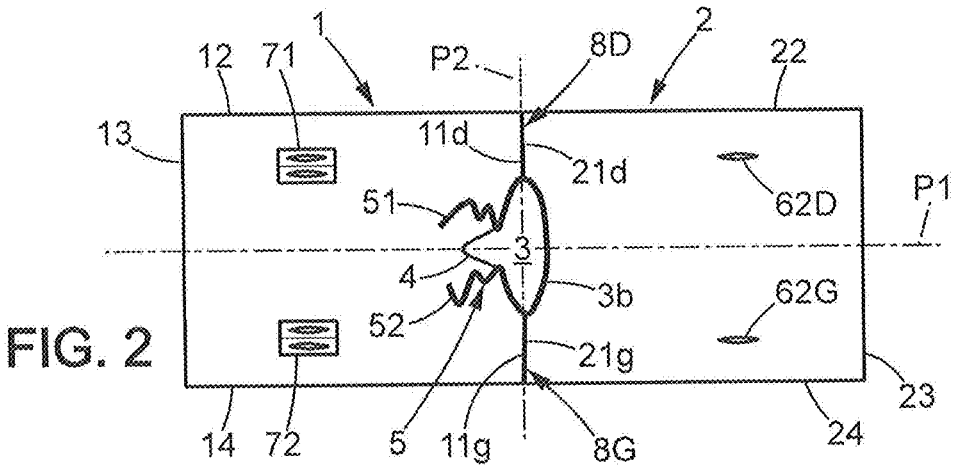
FIG. 2 represents an intermediate assembly step with the front and back panels assembled and the lash set in place.
Figure 3:
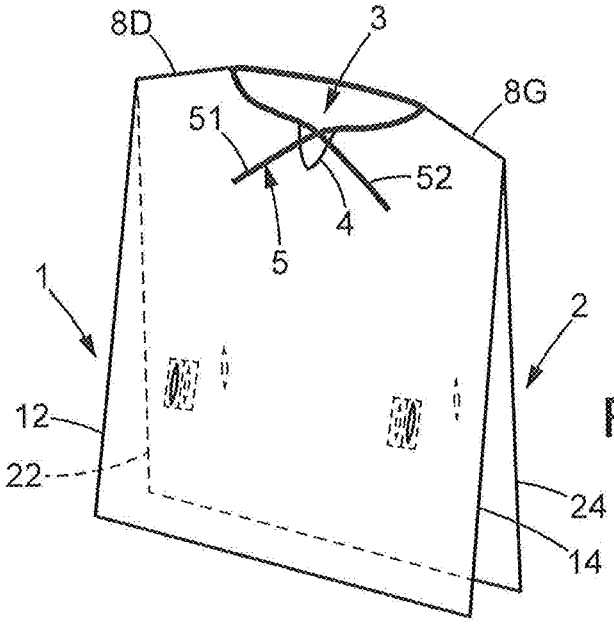
FIG. 3 illustrates in a perspective view another intermediate assembly step, just before the step when the connection is made near the belt passages.

FIGS. 1 to 3 present the different steps of fabrication of a convertible garment complying with the first embodiment of the present invention.

First two rectangular pieces of cloth are cut, they will form the front panel 1 and the back panel 2 of the final garment.

For a garment a longitudinal plane of symmetry P1 is defined; when the garment is worn, this plane should coincide with the midsagittal plane of the wearer.

The first piece of cloth 1 that will become the front panel has a slant/inclined border 11 aimed to be attached to the second piece of cloth 2, a second straight border 12, a third straight border 13 on the opposite side of the first border 11, and a fourth straight border 14 on the opposite side of the border 12.

The second piece of cloth 2 that will become the back panel has a slant/inclined border 21 aimed to be attached to the first piece of cloth 1, a second straight border 22, a third straight border 23 on the opposite side of the first border 21, and a fourth straight border 24 on the opposite side of the border 22.

The second and fourth borders 12, 14, 22, 24 will form the side edge of the garment to build. The third borders 13, 23 will form the lower edges of the garment to build.

The first border 11 includes in its central area a concave edge 3*a*, 3*c* with a centred indentation 4. From both part of the central concave area, the border 11 extends with a left bevelled edge 11*g* and a right bevelled edge 11*d*.

The first border 21 includes in its central area a concave edge 3*b* and from both side a left bevelled edge 21*g* and a right bevelled edge 21*d*.

On the front panel 1 a first slit 61D (buttonhole like) is formed, and a second slit 61G (buttonhole like) is formed and they are placed symmetrically across P1 at a distance denoted K from one another and they are both positioned at a distance denoted E from the end 16, 17 of the bevelled area.

Notice that the length E is taken at half the height of the slits 61G, 61D and spans up to the upper corner 16, 17 of the front panel 1.

Similarly, on the back panel 2 a first slit 62D (buttonhole like) is formed and a second slit 62G (buttonhole like) is formed and they are placed symmetrically across P1 at a distance denoted K from one to another and they are positioned at a distance denoted E from the extremity 25, 26 of the bevelled area.

The first borders 11, 21 are then attached together by a seam in a median area denoted P2, at the level of two attachment areas respectively right and left denoted 8D and 8G. The concave edges 3*a*, 3*b*, 3*c* form together a central aperture denoted 3. In the central front area of the aperture, the latter is extended by an indentation 4 (likewise 'notched neckline') whose utility will be explained further.

A lash 5 is then assembled, the lash may be likewise called lace or string or thin cord.

Figure 4:
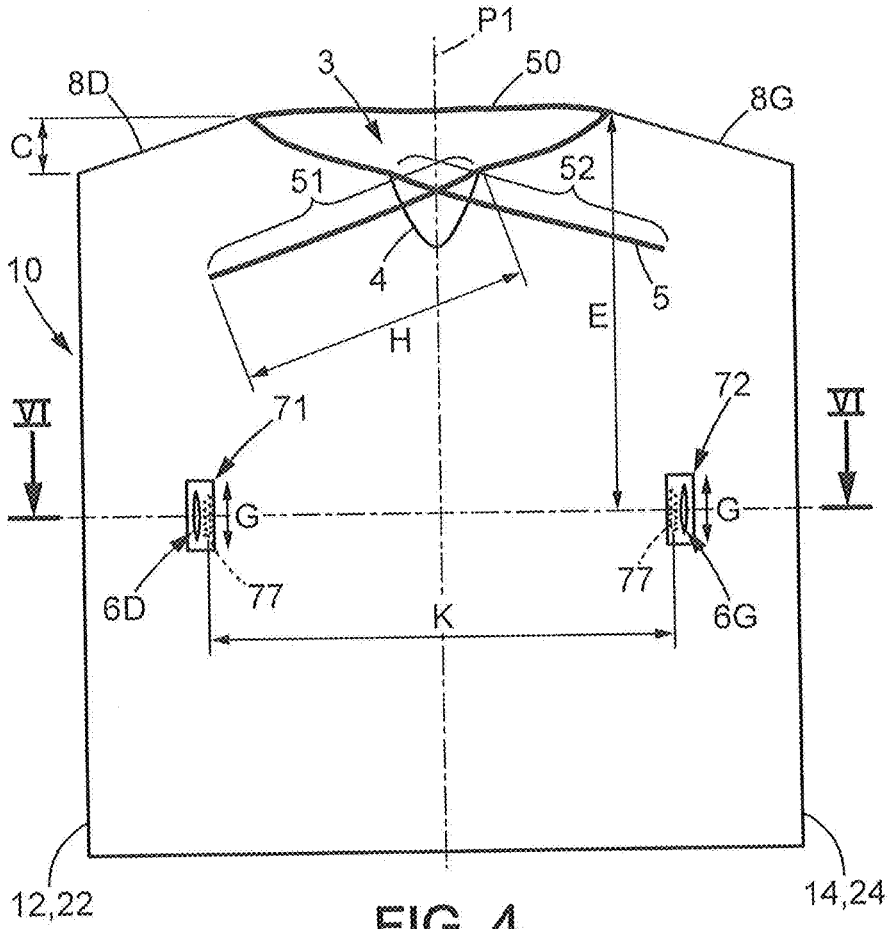
FIG. 4 represents a front elevation view of the assembled garment according to the first mode of embodiment.

As show in the FIGS. 2 to 4, the lash 5 comprises a central area 50 fixed on the edge of the central aperture 3 but not on the edge of the indentation, and from both sides, two free sections 51, 52 extend from the central area. The two free sections are meant to be adjusted in length and then knot together, around a body part of the wearer or simply knotted to one another.

The attachment of the central area 50 of the lash on the edge 3*a*, 3*b*, 3*c* of the central aperture may be continuous or discontinuous, either with a hem, or with another solution.

As will be shown further, the central aperture 3 with the indentation 4 features a total dimension which is more or less long given the more or less pronounced opening or closing of the indentation 4 by means of knotting of the lash 5.

Then comes the assembly of a first eyelet piece 71 with double buttonhole with one of its buttonholes 75 on the first panel, on the inside, in a position in correspondence with the first slit 61D of the first panel 1, and a second eyelet piece 72 with double buttonhole with one of its buttonholes in correspondence with the second slit 61G.

The assembly is done by sewing, even though gluing, snap fastening, zipping or loops & hooks (Velcro™) may not be excluded.

Finally we proceed to the final assembly, the cloth is folded in two over the median line P2 which contains the junctions 8D, 8G aforesaid. If the cloth has an inner face and an outer face, the two inner faces are brought toward each other. Then the first eyelet piece 71 with the double buttonhole (eyelet which may be called 'passant' for a belt) is assembled, after having it folded onto itself, to the back panel 2 near the second slit 62D so that the two buttonholes 75, 76 of the eyelet pieces and the two slits 61D, 62D are aligned to allow the easy threading of a belt 9. This alignment is illustrated specifically on FIG. 6 where a belt 9 is shown in dotted line.

The same is done to assemble the second eyelet piece 72 with the double buttonhole, after having it folded onto itself, to the back panel 2 near the second slit 62G. The garment 10 is now ready to be worn.

We notice that the eyelet pieces with double buttonholes are sewed to the front panel with a simple seam 77 are sewed to the back panel with a simple seam 78.

The height A of the garment will be comprised between 55 cm and 100 cm with a centring at about 80 cm, following a gradation presented further.

The width B of the garment will be comprised between 70 cm and 115 cm with a centring at about 100 cm, following a gradation presented further.

Preferably, the height A of the front panel and the back panel is the same. Also, preferably, the width B of the front panel and the back panel is the same.

The dimension C corresponds to the shoulder fit (the difference between the points of maximum height 16, 17 and the height of the lateral border 14, 12); the reference value for C is 6 cm.

Figure 5:
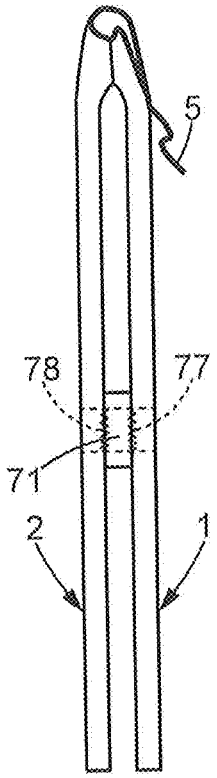
FIG. 5 shows a side elevation side view of the assembled garment.
Figure 6:
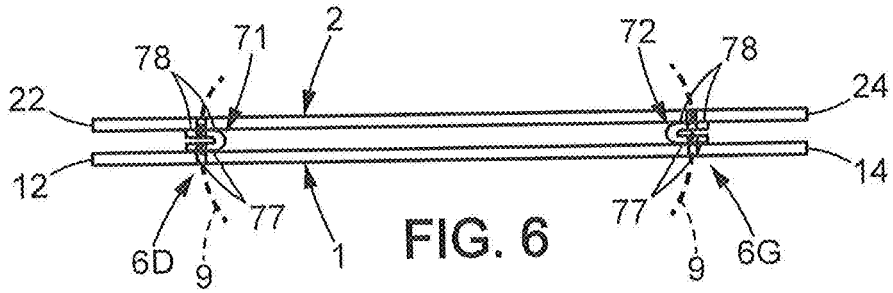
FIG. 6 shows a horizontal cut view of the assembled garment, following the VI-VI section cut on FIG. 4.
Figure 7:
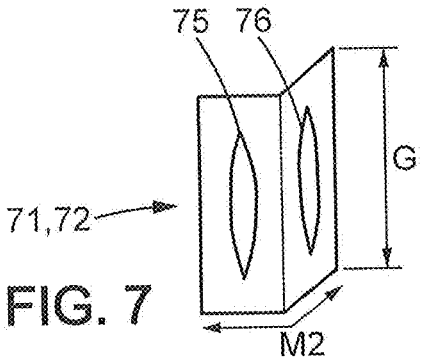
FIG. 7 presents with more details the attachment piece for the belt passages area.

As shown in the FIGS. 4 to 6, the first eyelet piece with double buttonhole 71, sewed near the first slits 61D, 62D form together a first passage denoted 6D, a right passage. On the left side, the second eyelet piece with double buttonhole 72, sewed near the second slits 61G, 62G form together a second passage denoted 6G, a left passage.

The distance K separating the two passages 6G, 6D is comprised between 70 cm and 80 cm, preferably between 72 cm and 75 cm.

The distance K is lesser than the width A of the garment; the seam connections are away from the lateral borders 12, 22, 14, 24.

The passages are at a distance E from the top end of the garment between 30 cm and 50 cm and specifically between 35 cm and 45 cm.

The length H of the free sections of the lash is between 30 cm and 60 cm, preferably between 40 cm and 50 cm. However, lengthier sizes are also considered.

The belt 9 has a height from 2 to 7 cm, a little lower than the height of the slits 61D, 62D and the height of the buttonholes 75, 76.

The cloth used here is essentially non-extensible. This may be a light fabric, preferably smooth or thick, threaded or non-threaded, leather, natural fibber, or synthetic.

The fabric may also be extensible, such as elastane, Lycra™ or else. Some rate of extensibility allows for better adaptation of the garment with the different morphologies of the wearers.

Figure 8:
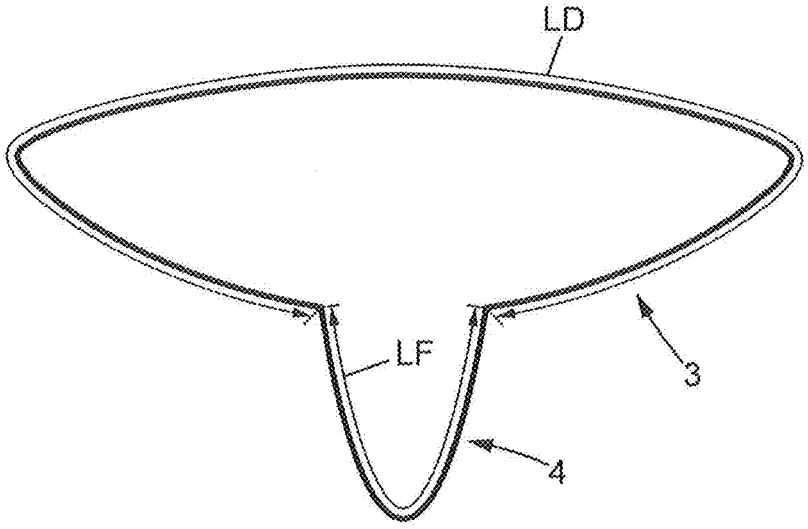
FIG. 8 presents the central aperture with the indentation.

As shown in FIG. 8, the developed length of the edge of the central aperture, without the indentation, denoted LD, will usually be between 60 cm and 95 cm with a centring around 82 cm following a gradation explained further, and the developed length of the indentation denoted LF will usually be between 10 cm and 25 cm with a centring around 16 cm following a gradation explained further.

Figure 9:
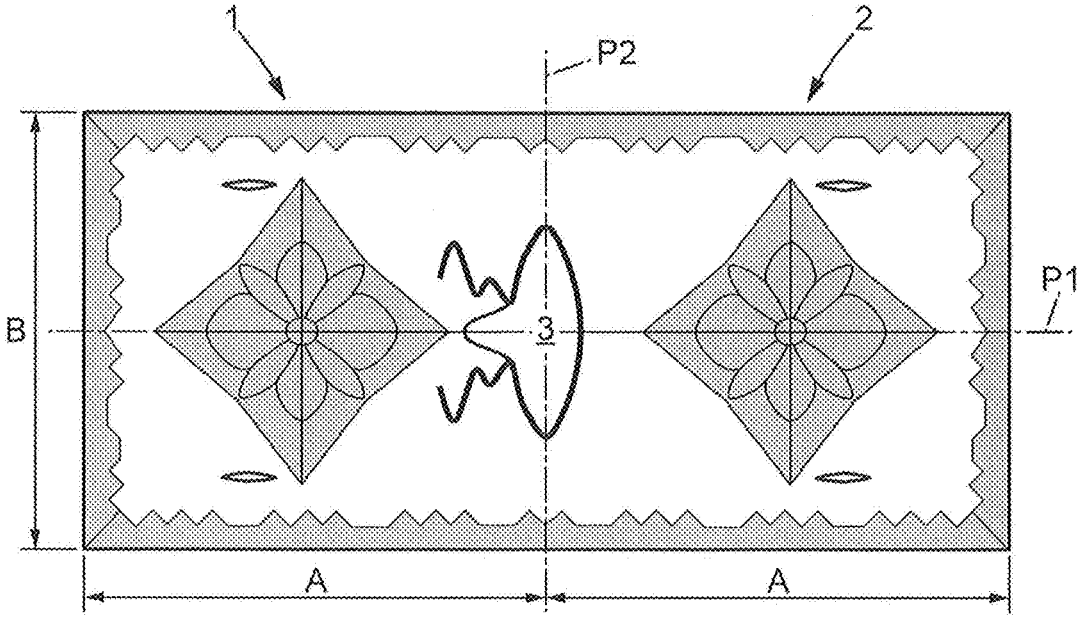
FIG. 9 presents a second embodiment.

In the second embodiment shown in FIG. 9, the front and back panels are made from a single piece of cloth, in this example there is no seam at the shoulder area, the junctions 8D, 8G are achieved with the continuity of the cloth. Notice also that the lateral border is continuous from the front panel to the back panel, and the pattern of the border may extend continuously without discontinuity, which is favourable from an aesthetic point of view. In this example, the shoulder fit denoted by the dimension C is null (flat shoulder line)

Figure 10A:
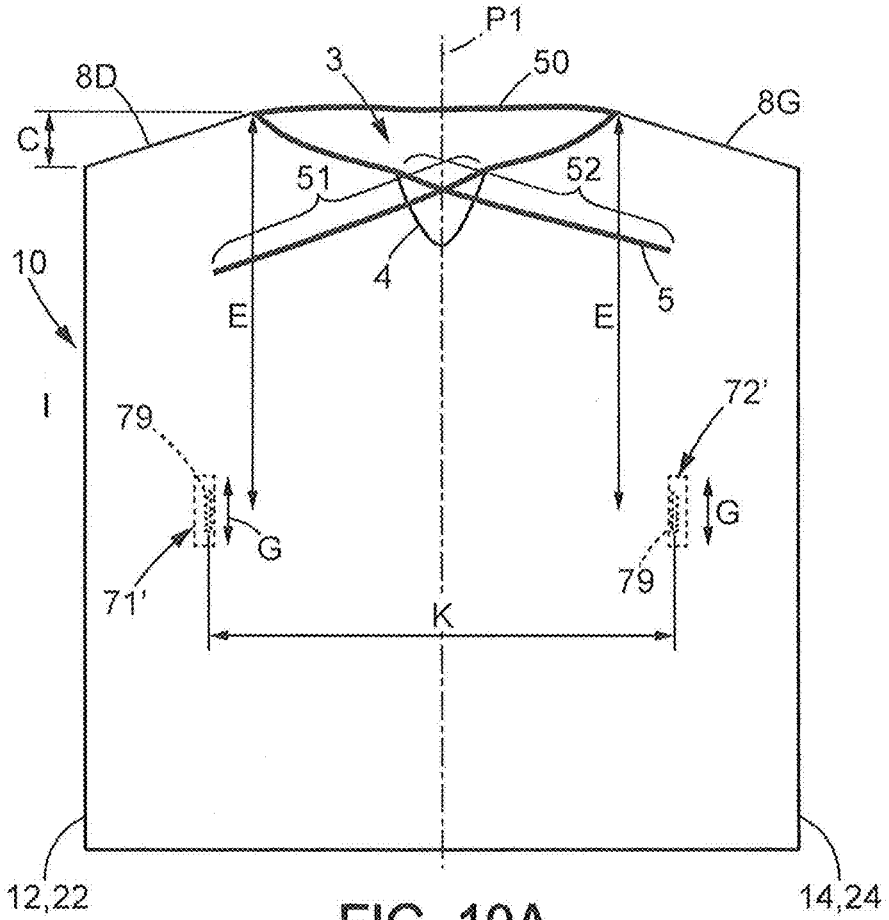
FIGS. 10A and 10B present a third embodiment.
Figure 10B:
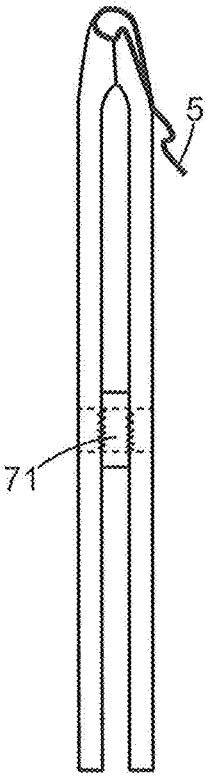

In a third embodiment shown in the FIGS. 10A 10B, there are provided seamed connections 71', 72' which may replace at respective locations the passages from the two prior embodiments.

In the shown example, the seamed connection 71' which is made out of a small piece of cloth 79 a few centimetres long (dimension G), and a few centimetres wide (dimension M2), this piece being sewed from one side to the front panel and from the other side to the back panel without buttonhole nor slit. It is the same for the left seam connection 72' which is similarly assembled symmetrically to the sagittal plane P1. The distance K separating the two seamed connections may be slightly different from the configuration with the belt passages.

In another version even more simplified, not shown, the seamed connections are simply made out of seams between the front panel and the back panel without intermediary part.

In other possibilities not shown, in the case where the belt passages are shown, the position of the seamed connections 71', 72' may be distinct and slightly offset by a few centimetres from the position of the slits forming the belt passages.

Thus, for example the seamed connections 71', 72' may be arranged on the inside more towards the centre of the garment from the position of threading 6D, 6G. Conversely, seamed connections 71', 72' are arranged on the outside more towards the centre of the garment from the position of threading 6D, 6G.

The dimension K is taken in the direction of the width starting from the innermost seam 71, 71', 72, 72. And in the direction of height, the dimension E is taken from the median height of the seamed connection, said otherwise is the reference point is at half the height of the buttonholes.

Gradation

The applicant has conducted anatomical and anthropometric studies to establish the following gradation table which defines the preferred intervals/ranges for the most important dimensions of the convertible garment.

TABLE 1

| | From 10-year-old to tall adult | Extended adult range | Baseline adult range | Adult women median range |
|---|---|---|---|---|
| A | from 55 cm to 100 cm | from 70 cm to 100 cm | from 75 cm to 95 cm | 78 cm |
| B | from 70 cm to 115 cm | from 95 cm to 115 cm | from 95 cm to 110 cm | 105 cm |
| LD | from 60 cm to 100 cm | from 70 cm to 95 cm | from 75 cm to 90 cm, and even from 78 cm to 86 cm | 82 cm |
| LF | from 10 cm to 25 cm | from 14 cm to 25 cm | from 15 cm to 20 cm | 18 cm |
| E | from 30 cm to 50 cm | from 40 cm to 50 cm | from 40 cm to 48 cm | 44 cm |
| K | from 60 cm to 80 cm | from 70 cm to 80 cm | from 70 cm to 76 cm | 74 cm |

Obviously, the different intervals of dimension are meant so that the presented solution fits well both a thin and a broader individual.

Examples of Wearing Configurations

It will now be illustrated several wearing configurations of the garment 10 on a user noted mannequin M.

Figure 11:
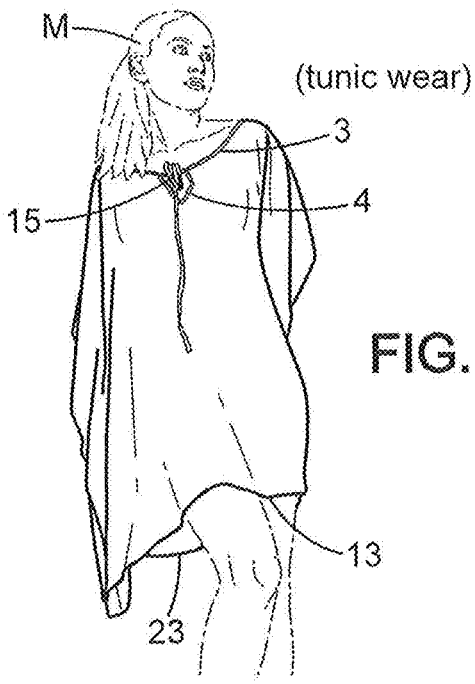
FIG. 11 presents the garment worn in tunic configuration.

In the tunic wear configuration (FIG. 11), the shoulder and the arms of the mannequin are covered by the cloth. The junctions 8D, 8G aforementioned are located above the shoulder and the arms. Both passages 6D, 6G (or respectively the seamed connections 71', 72') fall on the side of the thorax/torso and provide solidarity on the lateral part of the garment, consequently even though there are no lateral seams, the front and back panels come together properly to cover in the majority of cases the thorax/torso and abdomen of the mannequin.

The more or less wide opening of the indentation 4 allows to adapt to the stature of the wearer. Typically, as shown on the drawing a knot 15 closes the indentation;

The knot 15 is located below the base of the throat; in variation, it is also possible to make the free sections 51, 52 of the lash cross and to tie them with a knot 15 at the back of the neck (no shown).

In the shown example, the lower border 13 of the front panel 1 falls at mid-thigh, same goes for the inferior border 23 of the back panel 2.

Obviously, in this tunic configuration, a belt 9 may be used to achieve a baggy effect. The tunic may be centered more or less by attaching the belt 9 either before or behind the body.

In the poncho wear configuration (FIGS. 12A, 12B, 12C, 12D), the arms of the mannequin are covered by the cloth but by contrast with the former example, the shoulder are bare.

The junctions 8D, 8G aforementioned are located above the arms, but at a lower place. As in the former example, both passages 6D, 6G (or respectively the seamed connections 71', 72') provide structure and cohesion on the lateral part of the garment, consequently even though there are no lateral seams, the front and back panels come together properly to cover in the majority of cases the thorax/torso and abdomen of the mannequin.

As in the former example, the more or less wide opening of the indentation 4 allows to adapt to the stature of the wearer. Typically, the free sections of the lash 51, 52 would cross and a knot 15 would be tied at the back of the neck (FIG. 12A, 12D); but in the poncho configuration, the garment may also be worn without knot (FIG. 12B), for the arms and seamed connections provide (eyelets/passages) a natural hold.

In another variant (FIG. 12C), the free sections of the lash don't cross, they rise vertically from the top end 16, 17 of the cloth, and the knot is tied behind the neck. Note in this configuration the indentation is no closed but is rather in the shape of a V.

Obviously, in this poncho configuration too, a belt 9 may be used to achieve a baggy effect. The cloth may be centred more or less by attaching the belt 9 either before or behind the body.

Figure 12A:
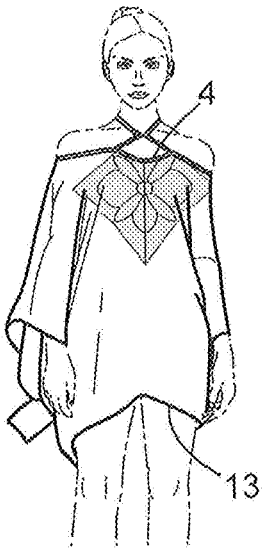
FIGS. 12A, 12B, 12C and 12D present the garment worn in light poncho configuration, respectively from the front and back, FIGS. 13A, 13B et 13C present the garment worn in backless dress configuration, respectively from the front and back.
Figure 12B:
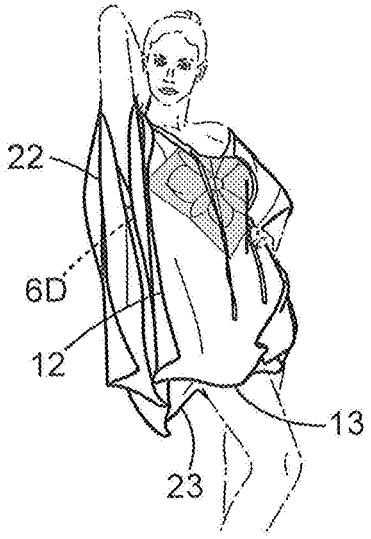
Figure 12C:
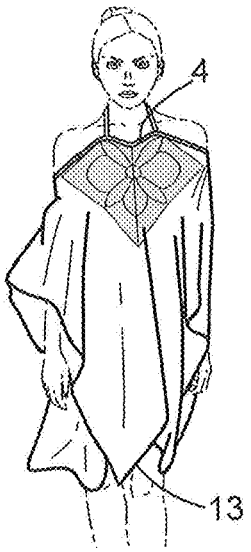

Note on FIG. 12B, the crucial role of the right seamed connection 6D, which even with the mannequin raising the arm, allows to close substantially the right side of garment.

Depending on the height A chosen, the inferior border 23 may land above or at the level of the knee.

In the backless dress wear configuration (FIG. 13A, 13B, 13C), the shoulders and the arms of the mannequin are not covered by cloth; the central aperture 3 surrounds the torso of the mannequin below the arms. A knot 15 is tied with the free sections 51, 52 of the lash behind the neck.

Figure 13A:
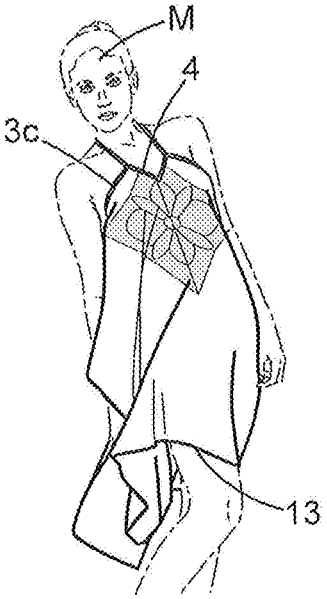

In another variant FIG. 13A), the free sections of the lash don't cross, they rise vertically from the top end 16, 17 of the cloth, and the knot is tied behind the neck. Note in this configuration the indentation is no closed but is rather in the shape of a V.

Figure 13B:
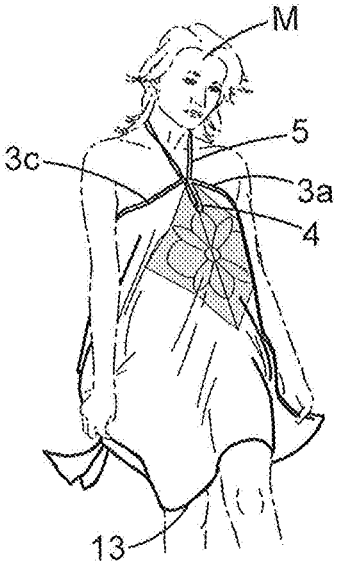
Figure 13C:
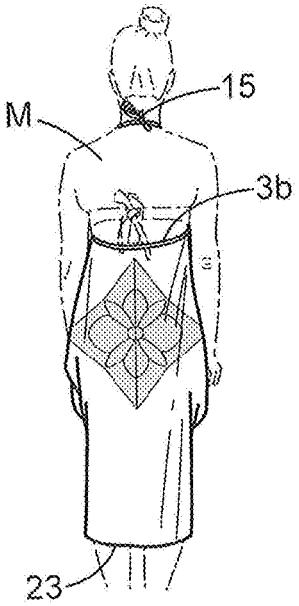

In a variant shown FIG. 13B the free sections of the lash cross, causing the indentation 4 to be completely shut.

The free sections of the lash may be shortened in any case, to adjust to the desired height and cover more or less the back of the mannequin (see FIG. 13C) depending on the torso of the person.

Under the arms, the junctions 8D, 8C provide a lateral closing for the thorax.

The two eyelets/passages 6D/6G (or respectively the seamed connections 71', 72') provide cohesive structure on the lateral part of the garment, consequently even though there are no lateral seams, the front and back panels come together properly to cover in the majority of cases the abdomen, hips, and thighs of the mannequin. In the event of long A, the legs are substantially covered by the lower part of the front panel, typically the lower border 23 falls below the knee. Depending on the morphology of the wearer and the dimensions A and B, in some examples, the lower border may reach the ankles.

Wearing a swimsuit (shown in dotted line) is of course compatible with the backless dress configuration.

Figure 14A:
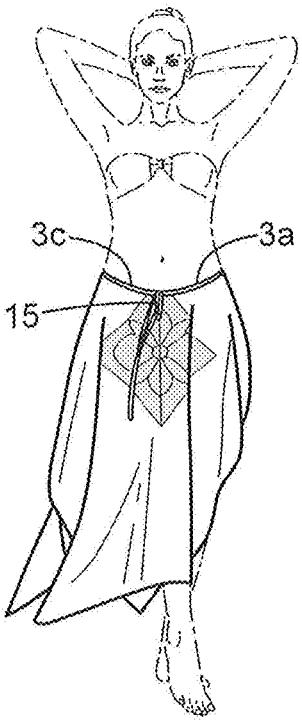
FIGS. 14A and 14B present the garment worn in skirt configuration respectively from the front and back.
Figure 14B:
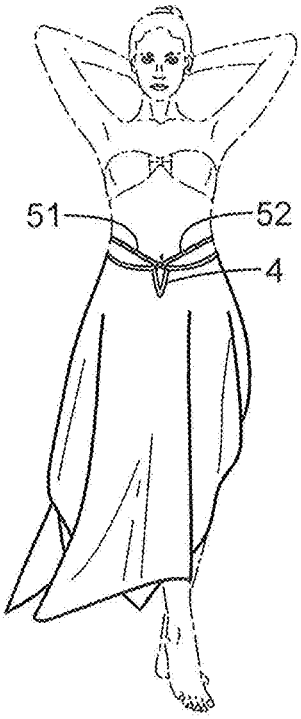

In the skirt wear configuration (FIGS. 14A, 14B), the central aperture 3 matches the waist (the hips) of the mannequin. A knot 15 may be tied in front of or behind the waist of the wearer according to the circumference of the waist and the length of the free section if the lash. The two passages 6D/6G (or respectively the seamed connections 71', 72') fall outside the thighs of the wearer.

Figure 16A:
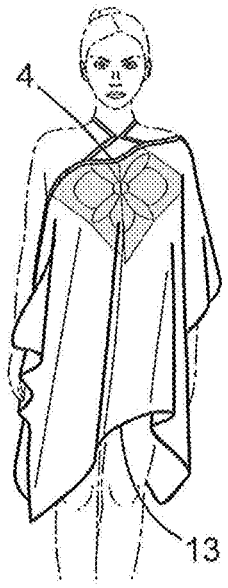
FIGS. 16A and 16B presents the garment worn in asymmetrical configuration from the front and back.
Figure 16B:
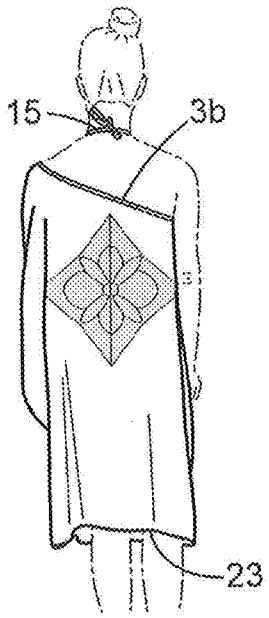

In the asymmetric wear configuration (FIGS. 161, 16B), the garment 10 covers one shoulder of the mannequin but not the other. A single arm is pulled between a junction area from one side and a eyelet/passage on the same side. The other arm is pulled inside the central aperture 3. The indentation 4 is completely open or nearly, as in the example of the summer poncho.

In the example shown, the right shoulder is bare and the left arm is pulled through the front and back panel under the junction 8G. The opposite is obviously possible.

For the lash 5, the knot 15 is tied behind the neck either behind the neck or by crossing in the front of neck (as shown) or without crossing.

Figure 15:
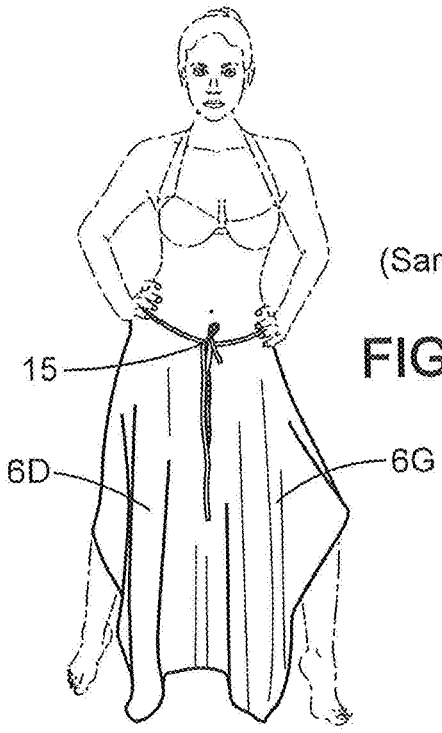
FIG. 15 presents the garment worn in sarouel configuration.
Figure 12D:
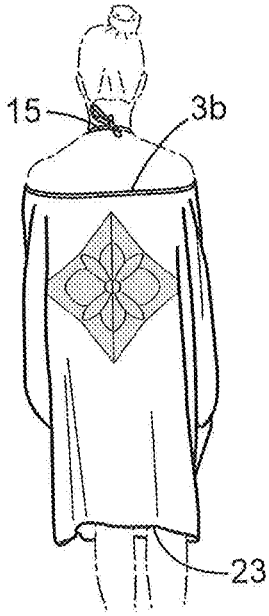

In the sarouel (FIG. 15) wear configuration, as the previous example, the central aperture 3 matches the waist (the hips) of the mannequin. But conversely to the previous examples, both passages 6D, 6G (or respectively the seamed connections 71', 72') locate between the thighs of the wearer. In the sarouel configuration, the legs are in the place occupied by the arm in the tunic/poncho configuration.

In the sarouel configuration, the exterior side of the legs and the thigh are bare even though the cloth falls lower, before and behind, hence its calling asymmetric.

In a peculiar configuration, the free ends of the lash are pulled to the back through the slits; after tying a knot behind the back, this creates a back "half belt".

Note that the borders/edges may be non-straight, with waves, windows, pearls etc.

In a variant not shown here, the shoulder junctions 8G 8D are detachable such as snap fasteners, zippers or loops & hooks (Velcro™).

In addition, with the aforementioned eyelets with detachable double buttonholes, this allows to have the front and/or the back of the garment interchangeable, thus the front and back panels can be exchanged/updated.

The invention claimed is:

1. A convertible garment wearable in several configurations: of wearing by an individual user, the garment defined by a symmetric longitudinal plane, a front, a back, a left and a right, the garment comprising:

a front panel and a back panel bound together at an intermediary area by a left shoulder junction and a right shoulder junction located on a left side and a right side of a central aperture respectively, with an indentation extending from a front side of the central aperture, the central aperture having an edge and the front panel and back panel having each a left lateral border and a right lateral border, a lash comprising a central section fixed on the edge of the central aperture but not on the edge of the indentation, and two free sections, each extending from a respective left side and a right side of the central section, the garment being deprived of a stitching connection joining the left lateral border of the front panel to the left lateral border of the back panel, and deprived of a stitching connection joining the right lateral border of the front panel to the right lateral border of the back panel, a right-side attachment piece forming a link between the front panel and the back panel at a right attachment area, a left-side attachment piece forming a link between the front panel and the back panel at a left attachment area, wherein each of the left side and right-side attachment pieces having a first end portion sewn to the front panel forming a first seam and a second end portion sewn to the back panel forming a second seam, and a free intermediate portion which allows some freedom of movement of the front and back panels therebetween, wherein the right and left attachment areas are arranged symmetrical on both sides of the symmetric longitudinal plane, away from the left and right lateral borders, spaced away from one another at a distance K, K being comprised between 70 cm and 80 cm, wherein the right attachment area is spaced away from the right shoulder junction by a distance E, wherein the left attachment area is spaced away from the left shoulder junction by the distance E, E being comprised between 35 cm and 50 cm, wherein the edge of the central aperture, excluding the indentation, exhibits a developed length denoted LD, wherein said developed length LD is comprised between 60 cm and 100 cm, wherein an edge of the indentation exhibits a developed length denoted LF, wherein said developed length LF is comprised between 10 cm and 25 cm, wherein each of the two free sections of the lash measures at least 40 cm so the two free sections can be wrapped around the user's body, whereby the length LD, length LF and the two free sections of the lash are such that the garment is selectively convertible between each of the following configurations of wearing:

a tunic configuration, with the two free sections of the lash knotted either at the front of a neck of the user or at a back of the neck of the user, a poncho configuration with bare shoulders, wherein the indentation is open to fit left and right shoulder outer portions, and with the two free sections of the lash knotted at the back of the neck of the user, a backless dress configuration, wherein the central aperture encompasses a chest of the user, with the two free sections of the lash knotted at the back of the neck of the user, and a skirt configuration, wherein the central aperture encompasses a waist of the user, wherein the two free sections of the lash are knotted in front of or behind the waist of the user, wherein the left-hand and the right-hand seam connections fall outside thighs of the user, and the garment can be worn further in:

an asymmetric configuration, wherein the garment covers one shoulder of the user but not another of the user, wherein the indentation is completely open, with the two free sections of the lash knotted at the back of the neck of the user, or a sarouel configuration, wherein the left-hand and the right-hand seam connections locate between the thighs of the user, wherein the two free sections of the lash are knotted in front of or behind the waist of the user.

2. The garment according to claim 1, further comprising at least two passages, wherein the at least two passages comprises a right passage and a left passage, each of the right and left passages comprising a first slit in the front panel and a second slit in the back panel, the right passage being arranged at the right attachment area and the left passage being arranged at the left attachment area.

3. The garment according to the claim 2, further comprising a belt configured to be threaded through the passages.

4. The garment according to claim 2, wherein the left-side attachment piece comprises two buttonholes forming part of the left passage, the right-side attachment piece comprises two buttonholes forming part of the right passage, wherein for each of the left and right passages respectively, the first and second slits and the two buttonholes are aligned to let a belt pass through.

5. The garment according to claim 1, wherein the front panel and the back panel have substantially a same size, with a height A being comprised between 55 cm and 100 cm, and a width B being comprised between 70 cm and 115 cm.

6. The garment according to claim 1, wherein each of the left and right shoulder junctions is formed as a seam connection.

7. The garment according to claim 1, wherein the front and back panels are made integrally from a single piece of cloth.

8. The garment according to claim 1, wherein said developed length LD is comprised between 70 cm and 95 cm, and said developed length LF is comprised between 14 cm and 25 cm.

9. The garment according to claim 1, wherein the distance K is comprised between 72 cm and 75 cm.

10. The garment according to claim 1, wherein the lash is fixedly secured to the edge of the central aperture.

* * * * *